US011445588B1

(12) United States Patent
Lu et al.

(10) Patent No.: US 11,445,588 B1
(45) Date of Patent: Sep. 13, 2022

(54) LIGHT-EMITTING DIODE LAMP WITH AFTERGLOW-PROOF FUNCTION

(71) Applicant: Xiamen PVTECH Co., Ltd., Fujian (CN)

(72) Inventors: Fuxing Lu, Fujian (CN); Zhirong Lin, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/400,101

(22) Filed: Aug. 11, 2021

(30) Foreign Application Priority Data

Apr. 14, 2021 (CN) ..... 202110400384.6

(51) Int. Cl.
*H05B 45/44* (2020.01)
*H05B 45/37* (2020.01)

(52) U.S. Cl.
CPC ..... *H05B 45/44* (2020.01); *H05B 45/37* (2020.01)

(58) Field of Classification Search
CPC ..... H05B 45/44; H05B 45/37
See application file for complete search history.

(56) References Cited

U.S. PATENT DOCUMENTS 10,616,971 B1 * 4/2020 Ajo ..... H05B 45/382
10,911,036 B1 * 2/2021 Chan ..... H03K 5/1252
2020/0120769 A1 * 4/2020 Tseng ..... H02M 1/08

* cited by examiner

*Primary Examiner* — Minh D A
(74) *Attorney, Agent, or Firm* — Winston Hsu

(57) ABSTRACT

A light-emitting diode lamp with afterglow-proof function is provided, which includes a power input terminal, a control circuit, a switching circuit, a rectifying circuit and a driving circuit. The power input terminal includes a first power input terminal connected to a first node and a second power input terminal connected to a second node. The control circuit is connected to the first and second nodes respectively. The switching circuit includes a first connection pin, a second connection pin, a third connection pin and a fourth connection. The first connection pin and the second connection pin are connected to the first and second nodes respectively. The driving circuit is connected to a plurality of light-emitting diodes. One end of the driving circuit is connected to the third connection pin via the rectifying circuit and the other end of the driving circuit is connected to the fourth connection pin.

9 Claims, 5 Drawing Sheets

LIGHT-EMITTING DIODE LAMP WITH AFTERGLOW-PROOF FUNCTION

Cross Reference To Related Application

This application claims the priority benefit of China Patent Application No. 202110400384.6, filed Apr. 14, 2021, and included herein by reference in its entirety.

BACKGROUND OF THE INVENTION

1. Field of the Invention

The technical field relates to light-emitting diode (LED) lamp, in particular to a LED lamp with afterglow-proof function.

2. Description of the Prior Art

As shown in FIG. 1, a light-emitting diode (LED) lamp 1 usually includes a metal heat sink 11 (made of aluminum or other metals), a lamp cover 12, a LED and a circuit board 14 (PCB). The circuit board 14 where the LED is disposed should be as close to the metal heat sink 11 as possible. Besides, the metal heat sink 11 is usually grounded in order to satisfy the safety standards.

There are three wires in the power input terminal of the LED lamp 1, which are live wire (L) , neutral wire (N) and earth wire (P/PE). The switch for turning on/off the LED lamp 1 can connect to only one of live wire and neutral wire. Accordingly, turning off the switch may disconnect neutral wire having no voltage difference with earth wire instead of live wire because of the user incorrectly installing the LED lamp 1 or other mistakes. Therefore, the LED lamp 1 can be turned off by operating the switch, but there must be still some al alternating current between the driving circuit and the metal heat sink 11.

A parasitic capacitance would be formed between the copper foil connecting the circuit board 14 to the LED 13, the isolator of the circuit board 14 and the metal heat sink 11 connected to earth wire. When there is some alternating current between the loop of the driving circuit and earth wire, the parasitic capacitance would keep be discharged, which results in afterglow of the LED lamp 1.

SUMMARY OF THE INVENTION

An embodiment of the present invention relates to a light-emitting diode (LED) lamp with afterglow-proof function, which includes a power input terminal, a control circuit, a switching circuit, a rectifying circuit and a driving circuit . The power input terminal includes a first power input terminal connected to a first node and a second power input terminal connected to a second node. The control circuit is connected to the first and second nodes respectively. The switching circuit includes a first connection pin, a second connection pin, a third connection pin and a fourth connection. The first connection pin and the second connection pin are connected to the first and second nodes respectively. The driving circuit is connected to a plurality of light-emitting diodes. One end of the driving circuit is connected to the third connection pin via the rectifying circuit and the other end of the driving circuit is connected to the fourth connection pin.

In accordance with an embodiment of the present invention, the LED lamp further includes a transformer circuit. The first power input terminal and a second power input terminal are respectively connected to the first node and the second node via the transformer circuit.

In accordance with an embodiment of the present invention, when the first power input terminal and the second power input terminal are connected to an alternating-current (AC) power source, the control circuit transmits a control signal to the switching circuit to turn on the switching circuit, such that the driving circuit drives the light-emitting diodes.

In accordance with an embodiment of the present invention, when the first power input terminal and the second power input terminal fail to connect to an AC power source, the control circuit stops transmitting the control signal to the switching circuit in order to turn off the switching circuit.

In accordance with an embodiment of the present invention, the switching circuit is disposed between the rectifying circuit and the driving circuit.

In accordance with an embodiment of the present invention, the switching circuit is a mechanical switch.

In accordance with an embodiment of the present invention, the rectifying circuit is a bridge rectifier.

In accordance with an embodiment of the present invention, the control circuit includes a bridge rectifier and a control chip.

In accordance with an embodiment of the present invention, the first power input terminal is live wire and the second power input terminal is neutral wire.

In accordance with an embodiment of the present invention, the first power input terminal is neutral wire and the second power input terminal is live wire.

As described above, the LED lamp with afterglow-proof function may have the following advantages:

(1) In one embodiment of the present invention, the LED lamp with afterglow-proof function includes a control circuit and a switching circuit disposed in front of the rectifying circuit of the main loop. Thus, the control circuit can turn off the switching circuit by stopping transmitting the control signal to the switching circuit on the condition that any one of the first and second power input terminals fails to connect to the AC power source. This mechanism can make sure that there is no voltage difference between the main loop and earth wire and effectively prevent the LED lamp from generating afterglow.

(2) In one embodiment of the present invention, each of the LEDs of the LED lamp is connected to a resistor, so the parasitic capacitance of each LED can be discharged via the resistor, which can completely eliminate afterglow and solve the problems caused thereby.

(3) In one embodiment of the present invention, the circuit of the LED lamp is simple and well-designed, so the LED lamp can achieve the desired technical effects without significantly increasing the cost thereof. Therefore, the LED lamp can have high commercial value.

Further scope of applicability of the present application will become more apparent from the detailed description given hereinafter. However, it should be understood that the detailed description and specific examples, while indicating exemplary embodiments of the present invention, are given by way of illustration only, since various changes and modifications within the spirit and scope of the present invention will become apparent to those skilled in the art from this detailed description.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will become more fully understood from the detailed description given herein below and the accompanying drawings which are given by way of illustration only, and thus are not limitative of the present invention and wherein.

DETAILED DESCRIPTION

Figure 1:
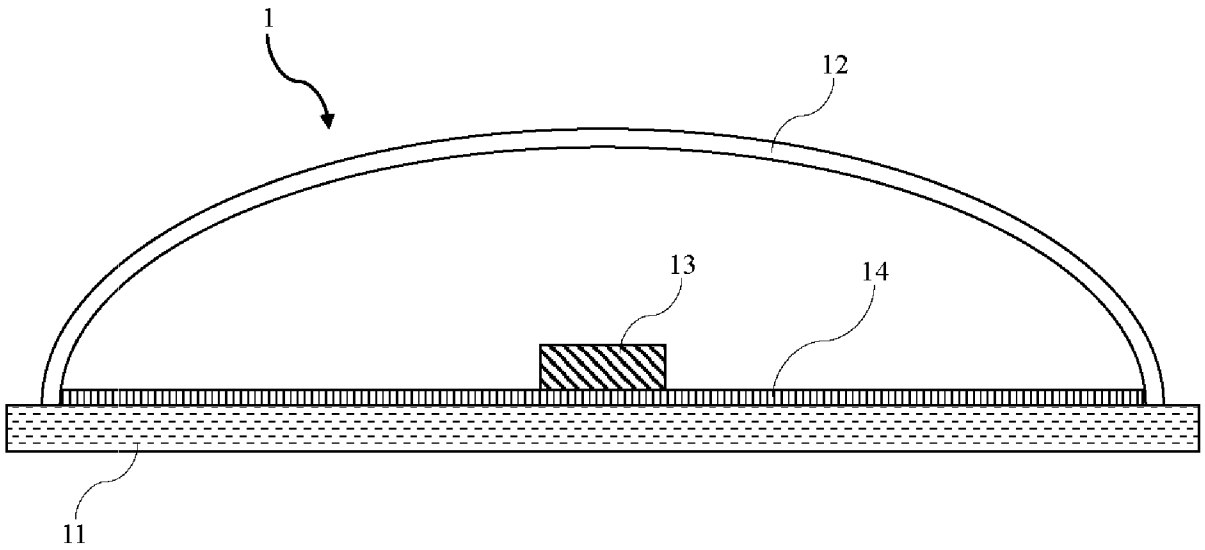
FIG. 1 is a schematic view of a currently available light-emitting diode (LED) lamp.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
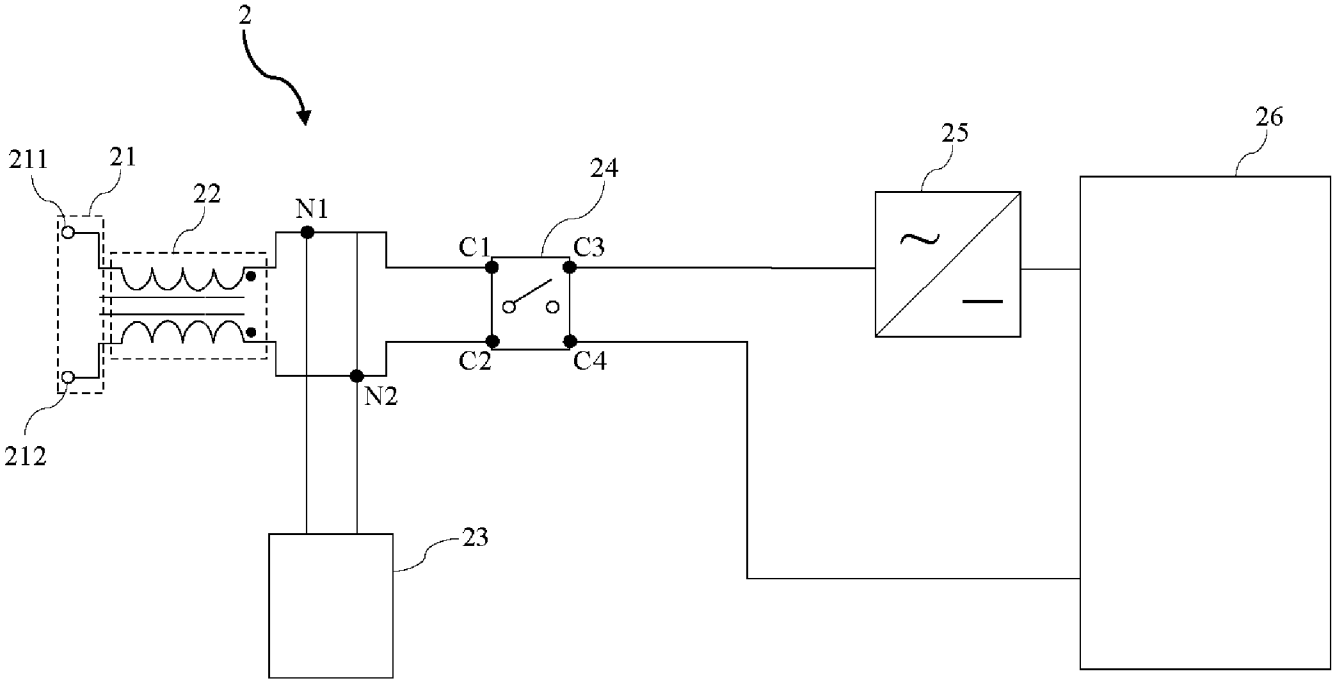
FIG. 2 is a circuit diagram of a LED lamp with afterglow-proof function in accordance with a first embodiment of the present invention.

Please refer to FIG. 2, which is a circuit diagram of a LED lamp with afterglow-proof function in accordance with a first embodiment of the present invention. As shown in FIG. 2, the LED lamp 2 with afterglow-proof function includes a power input terminal 21, a transformer circuit 22, a control circuit 23, a switching circuit 24, a rectifying circuit 25 and a driving circuit 26.

The power input terminal 21 includes a first power input terminal 211 and a second power input terminal 212. In one embodiment, the first power input terminal 211 may be live wire and the second power input terminal 212 may be neutral wire. In another embodiment, the first power input terminal 211 may be neutral wire and the second power input terminal 212 may be live wire.

The first power input terminal 211 and the second power input terminal 212 are respectively connected to a first node N1 and a second node N2 via the transformer circuit 22. In one embodiment, the control circuit 23 may be a control chip or other similar components.

The switching circuit 24 includes a first connection pin C1, a second connection pin C2, a third connection pin C3 and a fourth connection pin C4. The first connection pin C1 and the second connection pin C2 are connected to the first node N1 and the second node N2 respectively. In one embodiment, the switching circuit 14 may be a mechanical switch, such as relay or other similar components. In another embodiment, the switching circuit 24 may be other currently available switch components.

The driving circuit 26 is connected to a plurality of LEDs (not shown in the drawings). One end of the driving circuit 26 is connected to the third connection pin C3 via the rectifying circuit 26 and the other end of the driving circuit 26 is connected to the fourth connection pin C4. In one embodiment, the driving circuit 26 may be a LED driver or other similar components. In one embodiment, the rectifying circuit 25 may be a bridge rectifier or other similar components.

When the first power input terminal 211 and the second power input terminal 212 of the power input terminal 21 do not connect to an alternating-current (AC) power source, the control circuit 23 stops transmitting the control signal to the switching circuit 24 in order to turn off the switching circuit 24. At the moment, the AC power source is disconnected from the main loop including the driving circuit 26, so the electric signal of the AC power source cannot be coupled to the main loop via the parasitic capacitance, which can effectively prevent the LED lamp 2 from generating afterglow.

Figure 3:
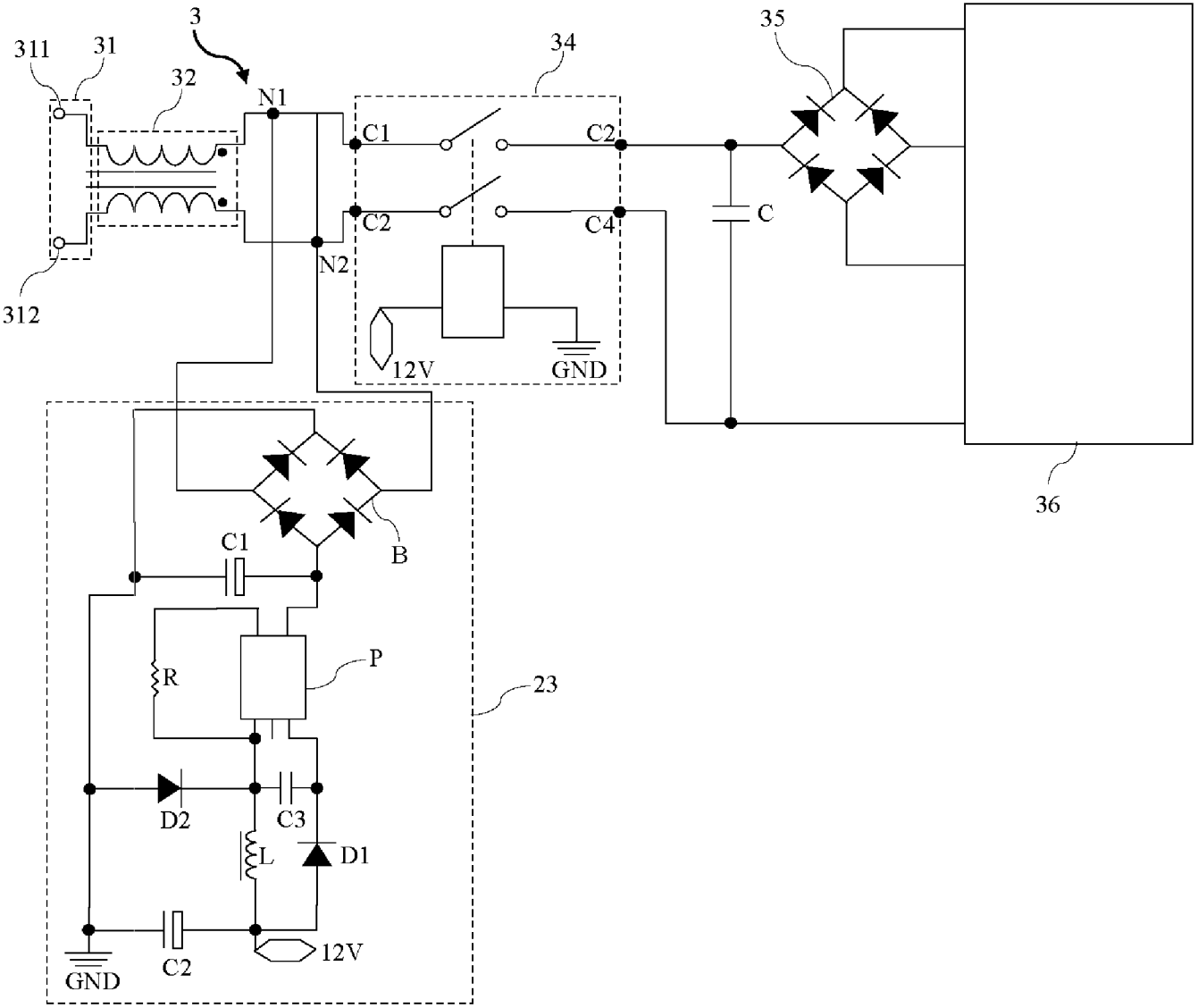
FIG. 3~FIG. 4 are circuit diagrams of a LED lamp with afterglow-proof function in accordance with a second embodiment of the present invention.
Figure 4:
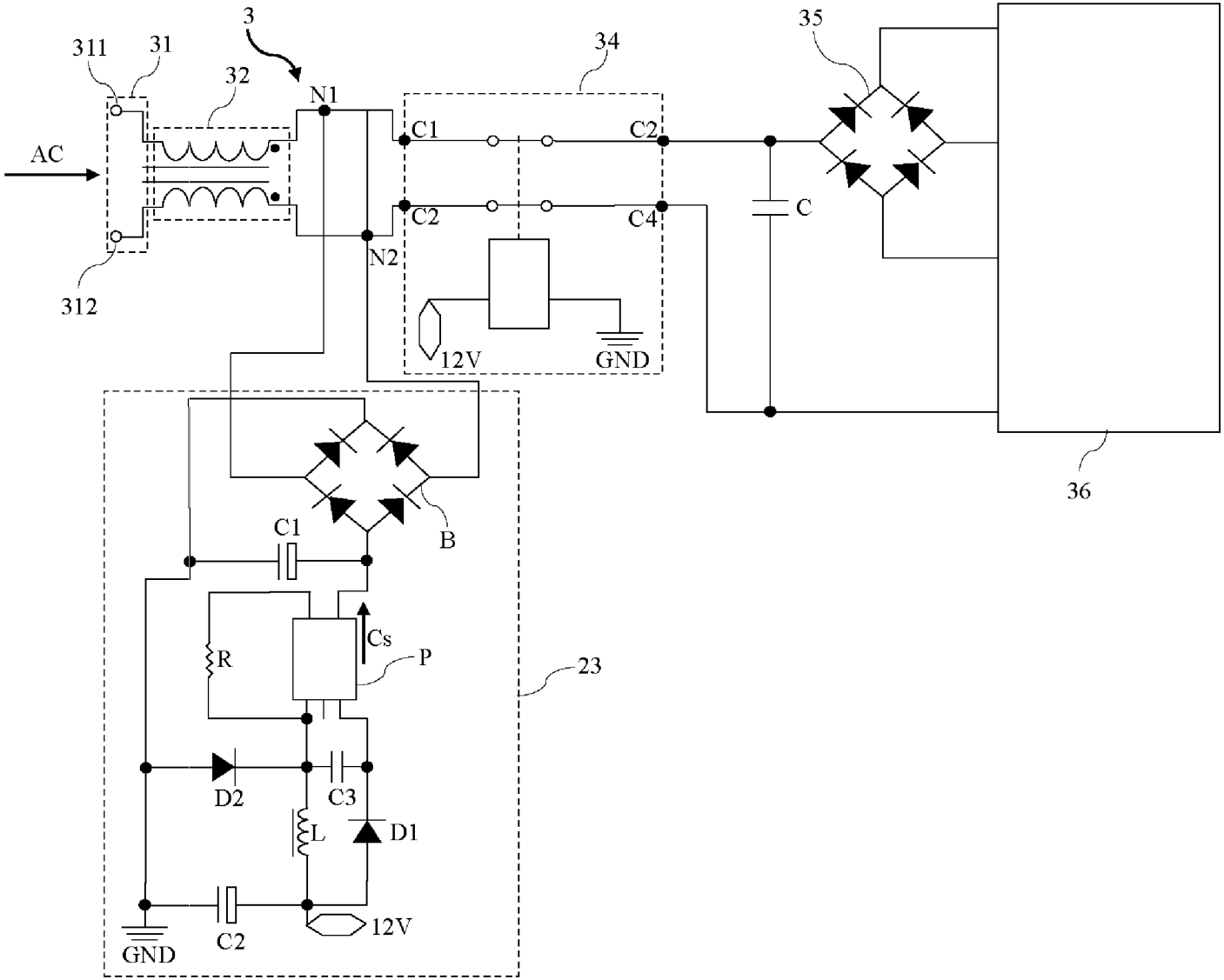

Please refer to FIG. 3-FIG. 4, which are circuit diagrams of a LED lamp with afterglow-proof function in accordance with a second embodiment of the present invention. As shown in FIG. 3, the LED lamp 3 with afterglow-proof function includes a power input terminal 31, a transformer 32, a control circuit 33, a relay 34, abridge rectifier 35 and a LED driver 36.

The power input terminal 31 includes a first power input terminal 311 and a second power input terminal 312. In one embodiment, the first power input terminal 211 may be live wire and the second power input terminal may be neutral wire.

The first power input terminal 311 and the second power input terminal 31 are respectively connected to a first node N1 and a second node N2 via the transformer 32.

The control circuit 33 are connected to the first node N1 and the second node N2 respectively. In the embodiment, the control circuit 33 mainly includes a bridge rectifier B, a control chip P, capacitors C1~C3, diodes D1~D2, an inductor L and a resistor R. The above content is just for illustration; the control circuit 33 can be realized by different circuit designs.

The relay 34 includes a first connection pin C1, a second connection pin C2, a third connection pin C3 and a fourth connection pin C4. The first connection pin C1 and the second connection pin C2 are connected to the first node N1 and the second node N2 respectively.

The LED driver 36 is connected to a plurality of LEDs (not shown in the drawings). One end of the LED driver 36 is connected to the third connection pin C3 via the bridge rectifier 35. The other end of the LED driver 36 is connected to the fourth connection pin C4.

As shown in FIG. 4, when the first power input terminal 311 and the second power input terminal 312 of the power input terminal 31 are connected to the AC power source to receive the electric signal AC therefrom, the control circuit 23 transmits a control signal CS to the relay 34 so as to turn on the relay 34. In this way, the main loop including the LED driver 36 can be connected to the AC power source and the LED driver 36 can drive the LEDs to emit light.

On the contrary, when the first power input terminal 311 and the second power input terminal 312 of the power input terminal 31 fail to connect to the AC power source, the control circuit 23 stops transmitting the control signal CS to the relay 34 so as to turn off the relay 34, as shown in FIG. 3. In this case, the AC power source cannot be connected to the main loop including the LED driver 36, so the electric signal of the AC power source cannot be coupled to the main loop via the parasitic capacitance. As a result, there is no voltage difference between the main loop and earth wire, so the LED lamp 3 never generates afterglow.

Figure 5:
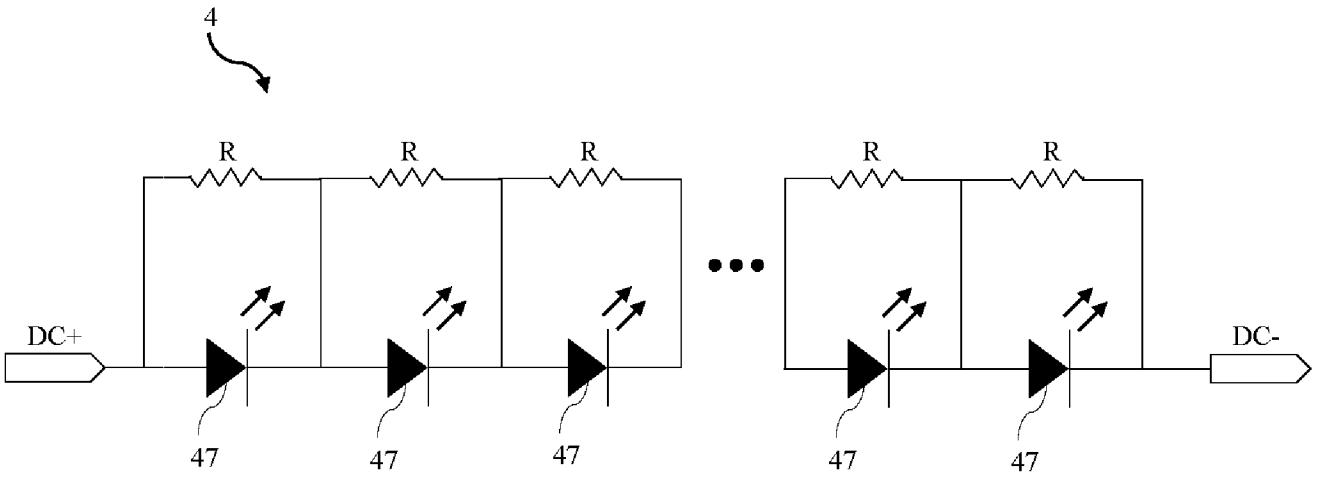
FIG. 5 is a circuit diagram of a LED lamp with afterglow-proof function in accordance with a third embodiment of the present invention.

Please refer to FIG. 5, which is a circuit diagram of a LED lamp with afterglow-proof function in accordance with a third embodiment of the present invention. As shown in FIG.

5, the LED lamp 4 with afterglow-proof function includes a plurality of resistors R respectively connected to the LEDs 47 in parallel.

When the LEDs 47 has yet to be turned on, the impedance of each LED 47 would be extremely high, which may be much more than 10 KΩ. In this case, the voltage difference of the parasitic capacitance of each LED 47 can be discharged by the resistor R (e.g. 10 KΩ) corresponding thereto, so the LED lamp 4 can achieve EMF (electromotive force) balance so as to prevent the LED lamp 4 from generating afterglow. When the LED lamp 4 normally operates, the total loss of the LEDs (3V) 47 and the resistors R is only about 0.0009 W. Therefore, the loss can be reduced to an almost negligible level. Besides, the cost of the LED lamp 4 is also low.

The above mechanism not only effectively prevents the LED lamp 4 from generating afterglow, but also significantly decreases the loss and the cost of the LED lamp 4.

To sum up, according to one embodiment of the present invention, the LED lamp with afterglow-proof function includes a control circuit and a switching circuit disposed in front of the rectifying circuit of the main loop. Thus, the control circuit can turn off the switching circuit by stopping transmitting the control signal to the switching circuit on the condition that any one of the first and second power input terminals fails to connect to the AC power source. This mechanism can make sure that there is no voltage difference between the main loop and earth wire and effectively prevent the LED lamp from generating afterglow.

Besides, according to one embodiment of the present invention, each of the LEDs of the LED lamp is connected to a resistor, so the parasitic capacitance of each LED can be discharged via the resistor, which can completely eliminate afterglow and solve the problems caused thereby.

Moreover, according to one embodiment of the present invention, the circuit of the LED lamp is simple and well-designed, so the LED lamp can achieve the desired technical effects without significantly increasing the cost thereof. Therefore, the LED lamp can have high commercial value.

It will be apparent to those skilled in the art that various modifications and variations can be made to the disclosed embodiments.

It is intended that the specification and examples be considered as exemplary only, with a true scope of the present invention being indicated by the following claims and their equivalents.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light-emitting diode lamp with afterglow-proof function, comprising:

a power input terminal, comprising a first power input terminal connected to a first node and a second power input terminal connected to a second node;

a control circuit, connected to the first node and the second node respectively;

a switching circuit, comprising a first connection pin, a second connection pin, a third connection pin and a fourth connection, wherein the first connection pin and the second connection pin are connected to the first node and the second node respectively;

a rectifying circuit;

a driving circuit, connected to a plurality of light-emitting diodes, wherein one end of the driving circuit is connected to the third connection pin via the rectifying circuit and the other end of the driving circuit is connected to the fourth connection pin; and a transformer circuit, wherein the first power input terminal and a second power input terminal are respectively connected to the first node and the second node via the transformer circuit.

2. The light-emitting diode lamp with afterglow-proof function of claim 1, wherein when the first power input terminal and the second power input terminal are connected to an alternating-current power source, the control circuit transmits a control signal to the switching circuit to turn on the switching circuit, whereby the driving circuit drives the light-emitting diodes.

3. The light-emitting diode lamp with afterglow-proof function of claim 2, wherein when the first power input terminal and the second power input terminal fail to connect to an alternating-current power source, the control circuit stops transmitting the control signal to the switching circuit in order to turn off the switching circuit.

4. The light-emitting diode lamp with afterglow-proof function of claim 1, wherein the switching circuit is disposed between the rectifying circuit and the driving circuit.

5. The light-emitting diode lamp with afterglow-proof function of claim 1, wherein the switching circuit is a mechanical switch.

6. The light-emitting diode lamp with afterglow-proof function of claim 1, wherein the rectifying circuit is a bridge rectifier.

7. The light-emitting diode lamp with afterglow-proof function of claim 1, wherein the control circuit comprises a bridge rectifier and a control chip.

8. The light-emitting diode lamp with afterglow-proof function of claim 1, wherein the first power input terminal is a live wire and the second power input terminal is a neutral wire.

9. The light-emitting diode lamp with afterglow-proof function of claim 1, wherein the first power input terminal is a neutral wire and the second power input terminal is a live wire.

* * * * *